US010020137B2

(12) United States Patent
Shitanaka et al.

(10) Patent No.: US 10,020,137 B2
(45) Date of Patent: Jul. 10, 2018

(54) INPUT APPARATUS

(71) Applicant: Panasonic Intellectual Property Management Co., Ltd., Osaka (JP)

(72) Inventors: Hitokazu Shitanaka, Fukui (JP); Hideaki Eto, Osaka (JP); Naoaki Matsui, Fukui (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/301,865

(22) PCT Filed: Apr. 1, 2015

(86) PCT No.: PCT/JP2015/001877
§ 371 (c)(1),
(2) Date: Oct. 4, 2016

(87) PCT Pub. No.: WO2015/159494
PCT Pub. Date: Oct. 22, 2015

(65) Prior Publication Data

US 2017/0117106 A1 Apr. 27, 2017

(30) Foreign Application Priority Data

Apr. 14, 2014 (JP) ..... 2014-082464

(51) Int. Cl.
*H01H 13/58* (2006.01)
*H01H 13/20* (2006.01)
*H01H 25/06* (2006.01)

(52) U.S. Cl.
CPC ..... *H01H 13/20* (2013.01); *H01H 25/06* (2013.01)

(58) Field of Classification Search
CPC ..... H01H 13/20; H01H 25/06
(Continued)

(56) References Cited

U.S. PATENT DOCUMENTS 3,226,991 A 1/1966 Hartsock
5,132,499 A 7/1992 Valenzona et al.
(Continued)

FOREIGN PATENT DOCUMENTS

DE 102011083524 A1 3/2013
JP 48-091471 U 11/1973
(Continued)

OTHER PUBLICATIONS

International Search Report of PCT application No. PCT/JP2015/001877 dated Jun. 23, 2015.
(Continued)

*Primary Examiner* — Edwin A. Leon
*Assistant Examiner* — Lheiren Mae A Caroc
(74) *Attorney, Agent, or Firm* — McDermott Will & Emery LLP

(57) ABSTRACT

An input apparatus includes a pressing part, a spacer, a rotating cam, and a sensor. The pressing part is capable of reciprocating along a first direction. The spacer is disposed in the first direction with respect to pressing part and is capable of reciprocating along the first direction with reciprocation of the pressing part. The rotating cam is disposed at a side of the spacer opposite to the pressing part and rotates in a plane perpendicular to the first direction with reciprocation of the spacer. The sensor detects rotation of the rotating cam.

4 Claims, 5 Drawing Sheets

(58) Field of Classification Search
USPC ..... 200/526–529, 566, 316, 520, 522
See application file for complete search history.

(56) References Cited

U.S. PATENT DOCUMENTS

| | | | | |
|---|---|---|---|---|
| 6,180,905 | B1 | 1/2001 | Pollock et al. | |
| 6,743,995 | B2 * | 6/2004 | Groves ..... | H01H 13/585 200/527 |
| 2015/0160683 | A1 | 6/2015 | Fust et al. | |

FOREIGN PATENT DOCUMENTS

| | | |
|---|---|---|
| JP | 2006-294259 | 10/2006 |
| JP | 2009-289659 | 12/2009 |

OTHER PUBLICATIONS

The Extended European Search Report dated Mar. 21, 2017 for the related European Patent Application No. 15780137.4.

* cited by examiner

INPUT APPARATUS

CROSS-REFERENCE TO RELATED APPLICATIONS

This application is a U.S. national stage application of the PCT International Application No. PCT/JP2015/001877 filed on Apr. 1, 2015, which claims the benefit of foreign priority of Japanese patent application No. 2014/082464 filed on Apr. 14, 2014, the contents all of which are incorporated herein by reference.

TECHNICAL FIELD

The present disclosure relates to an input apparatus for various types of electronic equipment.

BACKGROUND ART

In recent years, input apparatuses of a pressure manipulation type or a rotation manipulation type have been employed. Such an input apparatus is placed in a control panel in a cabin, and is used for manipulating various types of electronic equipment such as an audio set and an air conditioner in the cabin. Thus, an input apparatus that is easy to use and ensures manipulation is required.

FIG. 5 is a vertical cross-sectional view of a conventional input switch 60 (input apparatus). Pushing part 2, rotating part 3, and wiring part 4 are disposed in body 1. When pushing part 2 is pushed toward rotating part 3 along a center axis 50, cam surface 5 at a bottom surface of pushing part 2 and a cam surface 55 at an upper surface of rotating part 3 contact each other. In accordance with the pushing of pushing part 2 toward rotating part 3, rotating part 3 rotates around center axis 50.

The rotation of rotating part 3 causes connecting part 6 fixed to rotating part 3 to rotate around center axis 50. Connecting part 6 is electrically connected to wiring pattern 7 at an upper surface of wiring part 4. FIG. 5 illustrates a state in which pushing part 2 is substantially pushed so that connecting part 6 and wiring pattern 7 are connected to each other.

As described above, input switch 60 comes to be in a connected state by pushing of pushing part 2, and in a disconnected state by canceling the pushing.

Patent Literature 1, for example, is known as prior art of this application.

Citation List

Patent Literature

PTL 1: Japanese Unexamined Patent Application Publication No. 2006-294259

SUMMARY OF THE INVENTION

An input apparatus includes a pressing part, a spacer, a rotating cam, and a sensor. The pressing part is capable of reciprocating along a first direction. The spacer is disposed in the first direction with respect to the pressing part in the first direction and capable of reciprocating along the first direction with reciprocation of the pressing part. The rotating cam is disposed at a side of the spacer opposite to the pressing part and rotates in a plane perpendicular to the first direction with reciprocation of the spacer. The sensor detects rotation of the rotating cam.

A plurality of projections are provided on a surface of the spacer facing the rotating cam, whereas a plurality of recesses are provided in the rotating cam at locations facing the plurality of projections of the spacer. Alternatively, a plurality of projections are provided on a surface of the rotating cam facing the spacer, whereas a plurality of recesses are provided in the spacer at locations facing the plurality of projections of the rotating cam.

Each of the plurality of recesses has a slope.

Pressing of the pressing part causes the spacer to be pressed, and at least one of the plurality of projections presses the slope so that the rotating cam rotates and the sensor detects rotation of the rotating cam.

DESCRIPTION OF EMBODIMENT

Figure 1:
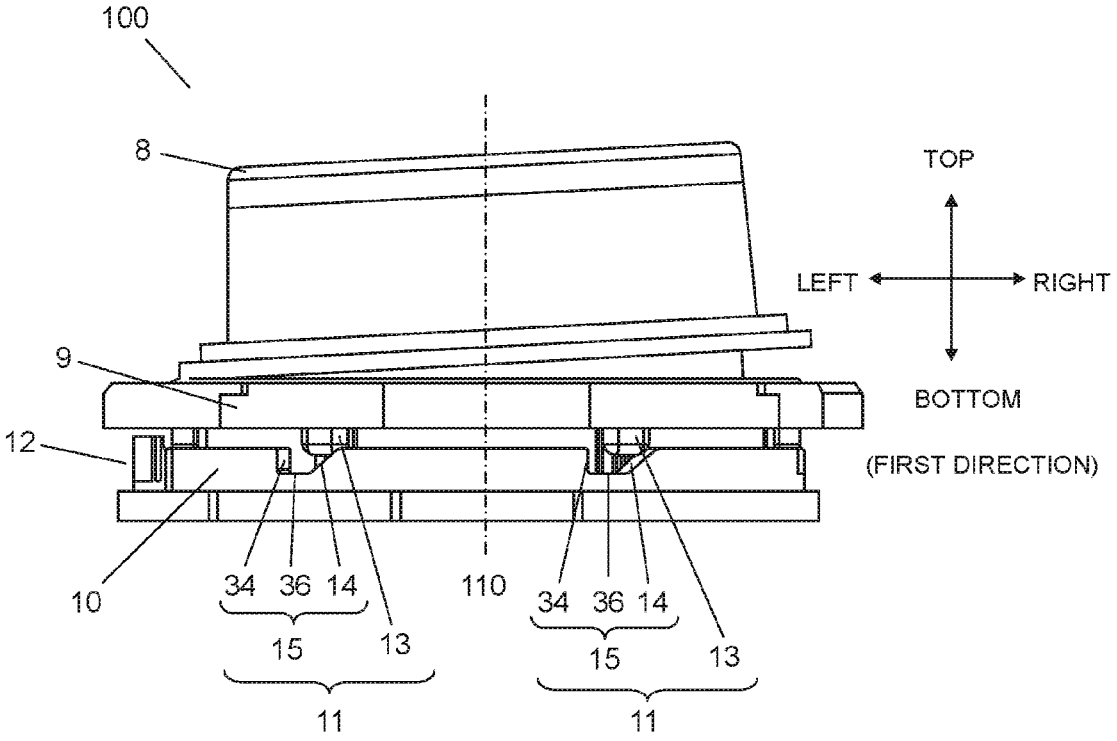
FIG. 1 is a side view of an input apparatus according to an exemplary embodiment.

In conventional input switch 60, a pushing operation performed on pushing part 2 is converted to a rotating operation of rotating part 3 by using cam surface 5 and cam surface 55. Thus, pushing part 2 needs to be linearly pushed accurately along center axis 50. That is, an operator needs to push pushing part 2 always in an appropriate direction. If this direction is tilted, switching between connection and disconnection of connecting part 6 and wiring pattern 7 cannot be easily performed.

FIG. 1 is a side view of input apparatus 100 according to an exemplary embodiment.

Input apparatus 100 includes pressing part 8, spacer 9, rotating cam 10, and sensor 12. Pressing part 8 can reciprocate along a first direction. Spacer 9 is disposed in the first direction with respect to pressing part 8 and can reciprocate along the first direction with reciprocation of the pressing part 8. Rotating cam 10 is disposed at a side of spacer 9 opposite to pressing part 8 and rotates in a plane perpendicular to the first direction with reciprocation of spacer 9. Sensor 12 detects rotation of rotating cam 10.

A plurality of projections 13 are provided on a surface of spacer 9 facing rotating cam 10. A plurality of recesses 15 are provided in rotating cam 10 at locations facing projections 13 of spacer 9. Alternatively, a plurality of projections 13 may be provided on a surface of rotating cam 10 facing spacer 9 with a plurality of recesses 15 being provided in spacer 9 at locations facing projections 13 of rotating cam 10.

Each of recesses 15 includes slope 14.

Pressing of pressing part 8 causes spacer 9 to be pressed, and at least one of projections 13 presses slope 14 so that rotating cam 10 rotates and sensor 12 detects rotation of rotating cam 10.

Embodiment

Input apparatus 100 will be specifically described hereinafter. Each of spacer 9 and rotating cam 10 has an annular shape. Spacer 9 moves upward and downward in accordance with upward and downward movements of pressing part 8. Spacer 9 reduces a tilt of pressing part 8. Rotating cam 10 rotates in accordance with upward and downward movements of spacer 9. Sensor 12 detects rotation of rotating cam 10, and outputs an ON signal or an OFF signal. As illustrated in FIG. 1, an upward direction is a direction toward pressing part 8 from spacer 9, and a downward direction (first direction) is a direction toward rotating cam 10 from spacer 9.

Projections 13 are provided on spacer 9. Recesses 15 are provided in rotating cam 10 at locations facing projections 13. Projections 13 and recesses 15 constitute conversion mechanisms 11. Each of recesses 15 includes slope 14, first surface 34, and flat portion 36 disposed between slope 14 and first surface 34. An angle formed by slope 14 and flat portion 36 may be smaller than an angle formed by first surface 34 and flat portion 36. The angle formed by first surface 34 and flat portion 36 may be 90°. This configuration enables a pressing operation to be smoothly converted to a rotating operation.

Spacer 9 reduces a tilt of pressing part 8, and moves upward and downward in accordance with upward and downward movements of pressing part 8. Even when an outer peripheral portion of pressing part 8 is pressed so that pressing part 8 moves upward and downward with a tilt, spacer 9 can reduce the tilt. This ensures a manipulation of input apparatus 100.

At least one of projections 13 among projections 13 faces at least a corresponding one of recesses 15. Pressing of pressing part 8 causes projections 13 to press slopes 14. Accordingly, rotating cam 10 rotates. That is, conversion mechanisms 11 convert a pressing operation (upward and downward movements) of pressing part 8 to a rotating operation (rotating operation of rotating cam 10).

Movement of projections 13 along slopes 14 of recesses 15 causes the pressing operation to be converted to the rotating operation. That is, conversion mechanisms 11 smoothly convert the pressing operation to the rotating operation. Even in a case where at least one of projections 13 faces a corresponding one of recesses 15 and is pressed with a small force, the pressing operation is smoothly converted to the rotating operation. Sensor 12 detects a rotating state of rotating cam 10 in a non-contact manner.

Side surfaces of pressing part 8 are not guided. Thus, pressing part 8 can be pressed with a tilt in some cases. However, since conversion mechanisms 11 convert the pressing operation to the rotating operation, even when pressing part 8 is pressed with a tilt, switching between ON and OFF can be stably performed.

In this embodiment, spacer 9 has projections 13, and rotating cam 10 facing projections 13 includes recesses 15. Alternatively, rotating cam 10 may include projections 13 with spacer 9 including recesses 15.

Figure 2:
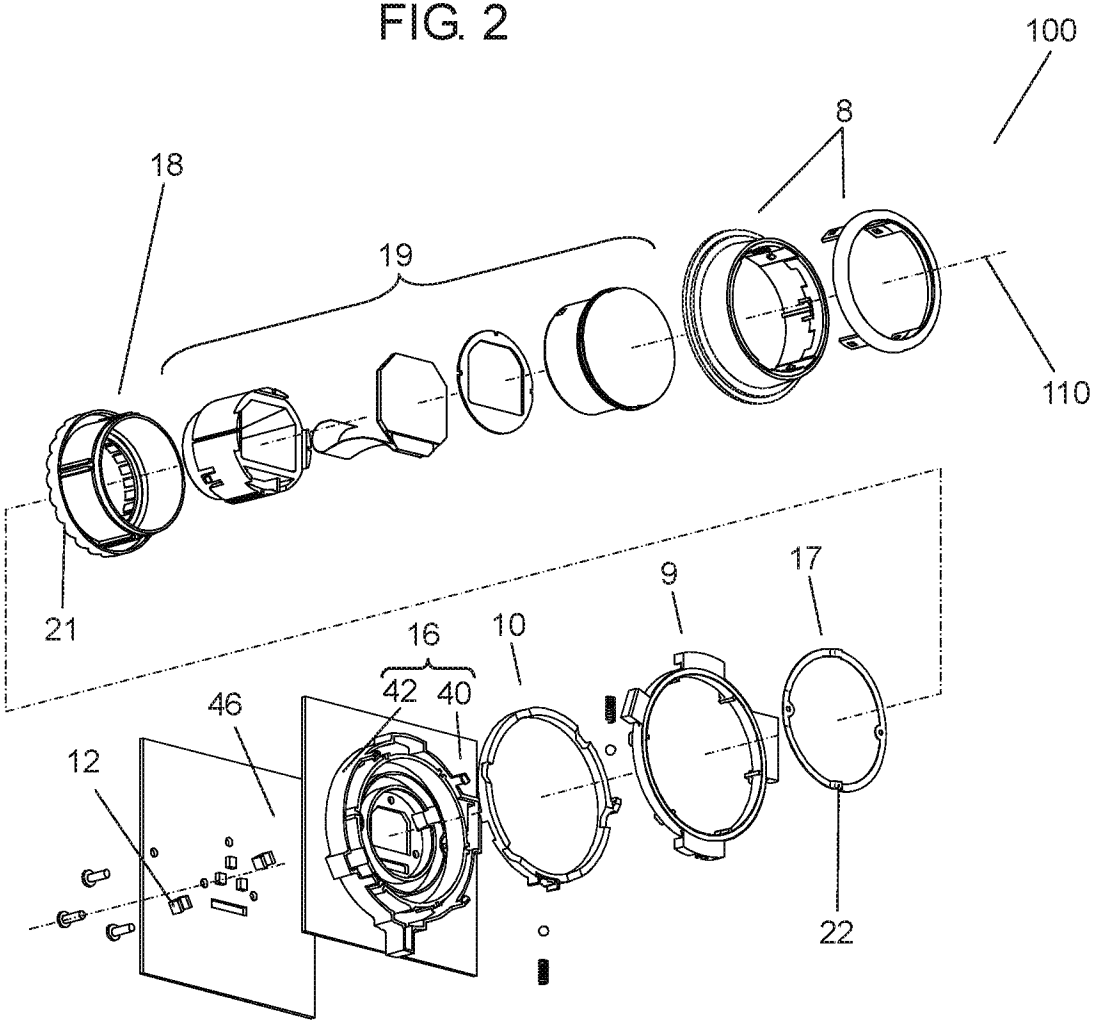
FIG. 2 is a disassembled perspective view of the input apparatus according to the exemplary embodiment.
Figure 3:
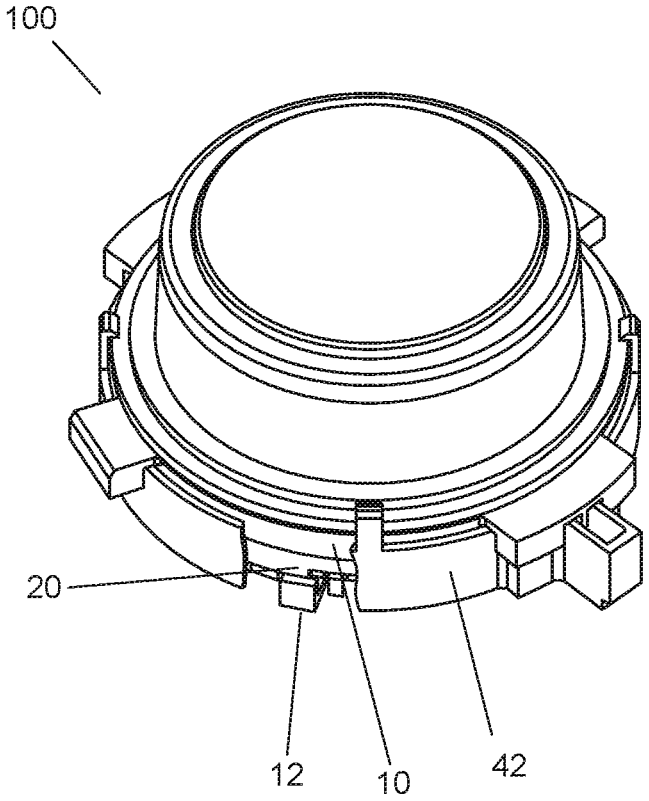
FIG. 3 is a perspective view of the input apparatus according to the exemplary embodiment.
Figure 4:
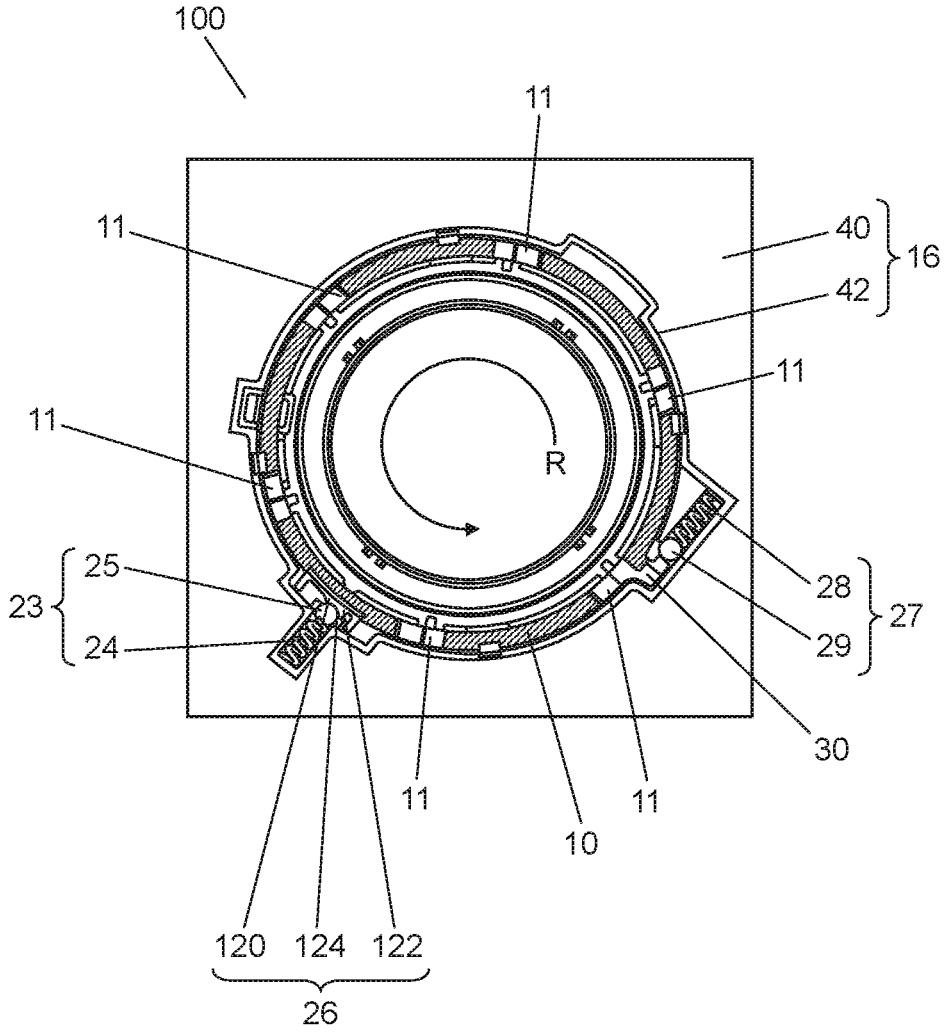
FIG. 4 is a horizontal cross-sectional view of the input apparatus according to the exemplary embodiment.
Figure 5:
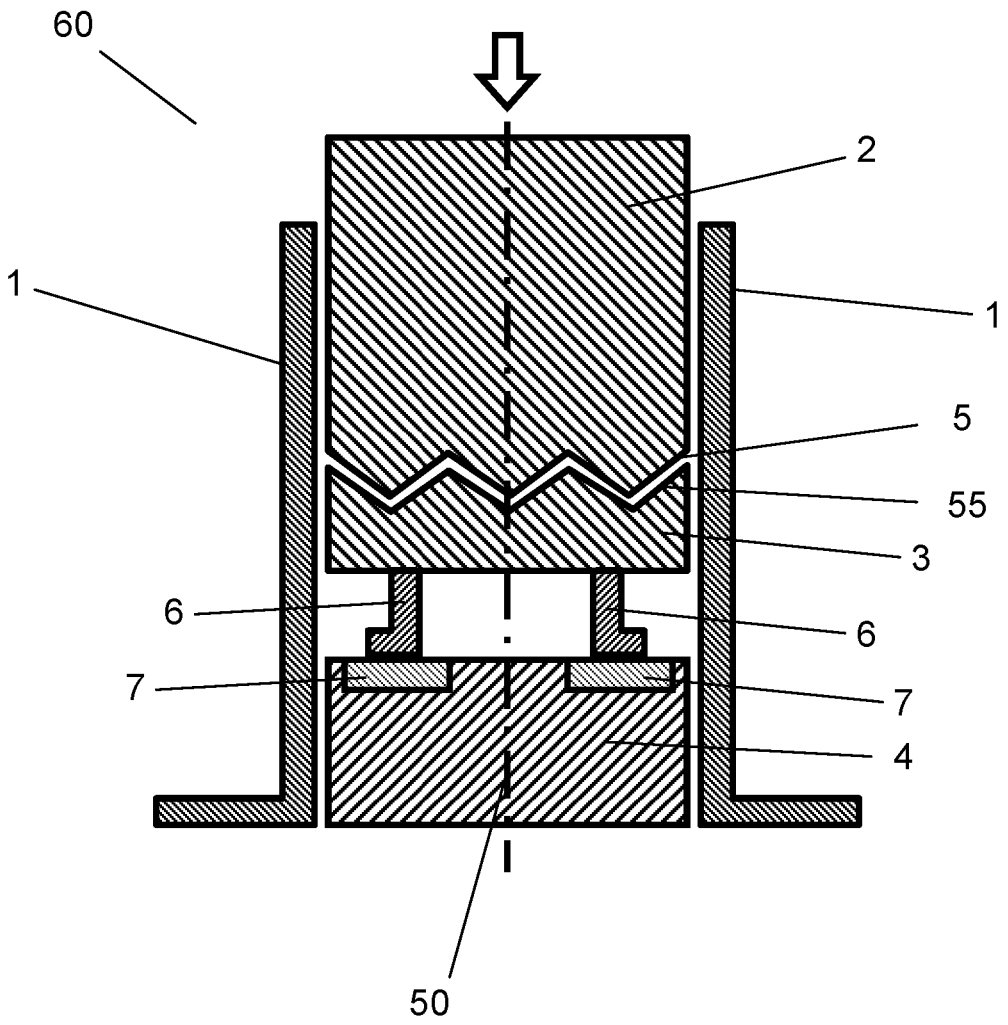
FIG. 5 Prior Art
FIG. 5 is a vertical cross-sectional view of a conventional input apparatus.

With reference to FIGS. 1 through 4, a detailed configuration and a detailed operation of input apparatus 100 will now be described. FIG. 2 is a disassembled perspective view of input apparatus 100 according to the exemplary embodiment. FIG. 3 is a perspective view of input apparatus 100 according to the exemplary embodiment. FIG. 4 is a horizontal cross-sectional view of input apparatus 100 according to the exemplary embodiment.

Input apparatus 100 is constituted by stacking base 16, rotating cam 10, spacer 9, click spring 17, rotating manipulation unit 18, display unit 19, and pressing part 8 in this order on board 46 provided with sensor 12. Pressing part 8 moves upward and downward along center axis 110. Movement of pressing part 8 is transmitted to spacer 9.

When an outer peripheral portion of pressing part 8 is partially pressed, pressing part 8 moves upward and downward with a tilt. Base 16 includes base portion 40 and guide portion 42. Guide portion 42 is formed around rotating cam 10 and projects from base portion 40 toward spacer 16. Since spacer 9 is guided by guide portion 42 of base 16, a tilt of spacer 9 is reduced. Specifically, even when pressing part 8 moves upward and downward with a relatively large tilt, spacer 9 hardly tilts while moving upward and downward. That is, the tilt of spacer 9 caused by upward and downward movements of spacer 9 is smaller than the tilt of pressing part 8 caused by upward and downward movements of pressing part 8.

In a state where an operator does not touch pressing part 8, that is, where the operator does not manipulate pressing part 8, projections 13 are not in contact with slopes 14.

When the operator presses pressing part 8, pressing part 8 moves downward. With the movement of pressing part 8, spacer 9 also moves downward so that projections 13 press slopes 14. A displacement in the rotation direction occurs in rotating cam 10 in accordance with displacement in the pressing direction of pressing part 8. When rotation of rotating cam 10 reaches a predetermined angle, shielding part 20 provided in rotating cam 10 reaches a location corresponding to sensor 12, as illustrated in FIG. 3. Consequently, sensor 12 detects that the operator presses pressing part 8, and outputs an ON signal. When the operator cancels pressing of pressing part 8, shielding part 20 moves from the location corresponding to sensor 12, and sensor 12 outputs an OFF signal. That is, with movement of shielding part 20, sensor 12 outputs an ON signal or an OFF signal.

As sensor 12, a photointerrupter is preferably used. The use of the photointerrupter enables detection of rotation of rotating cam 10 without application of a mechanical stress or resistance to a rotating operation of rotating cam 10. Alternatively, instead of sensor 12, a push type or a lever type connecting part (not shown) may be used so that movement of shielding part 20 causes the connecting part to turn ON or OFF (contact or non-contact).

When the operator cancels pressing (removes a hand or a finger from pressing part 8), pressing part 8 returns to an initial position. The initial position herein is a state in which projections 13 are not contact with slopes 14, and a highest position to which pressing part 8 rises in FIG. 1.

In this manner, slopes 14 have the function of converting a pressing operation to a rotating operation with pressing of pressing part 8. In addition, slopes 14 also have the function of converting a rotating operation to a pressing operation with canceling of pressing of pressing part 8.

Slopes 14 also have the function of a reversible operation. Specifically, when projections 13 move on slopes 14, a pressing operation is converted to a rotating operation, and when projections 13 are separated from slopes 14, a rotating operation is converted to a pressing operation (linear operation). To achieve this function, it is sufficient that one recess 15 corresponds to one slope 14. That is, as illustrated in FIG. 1, in each of recesses 15, the angle formed by first surface 34 and flat portion 36 may be 90°.

As described above, conversion mechanisms 11 are constituted by projections 13 and recesses 15. Projections 13 and recesses 15 are disposed in the same circumference. In this manner, conversion from a pressing operation to a rotating operation and conversion from a rotating operation to a pressing operation (linear operation) can be smoothly performed.

Projections 13 are provided on annular spacer 9. Recesses 15 are provided in annular rotating cam 10. Thus, pressing part 8 can easily rotate rotating cam 10 with a moment. For this reason, all projections 13 do not need to press all recesses 15. That is, pressing part 8 can rotate rotating cam 10 only by pressing at least one recess 15 with at least one projection 13.

Specifically, even when the operator locally presses pressing part 8, the pressing force (pressing operation) is easily converted to a rotating force (rotating operation) of rotating cam 10. FIG. 1 illustrates a case where the operator presses a left side of pressing part 8. Even in this case, projections 13 at the left side press recesses 15 so that the pressing force is easily converted to a rotating force of rotating cam 10. Even when the operator performs an insufficient pressing manipulation, input apparatus 100 can sufficiently detect this manipulation. Thus, input apparatus 100 has high operability. The left side herein refers to a side where sensor 12 is present in FIG. 1.

Conversion mechanisms 11 are preferably disposed on spacer 9 and rotating cam 10 at substantially regular intervals.

As illustrated in FIG. 4, in this embodiment, conversion mechanisms 11 are disposed at six locations with intervals of about 60°. The interval of conversion mechanisms 11 may slightly vary, however. In a case where rotating cam 10 is divided into two semi-arc portions by an arbitrary center line, for example, it is sufficient that conversion mechanisms 11 are disposed at at least two locations in one semi-arc portion. With this configuration, even when the operator locally presses pressing part 8, the pressing force is easily converted to a rotating force of rotating cam 10.

Columnar display unit 19 is fixed to base 16 and projects toward pressing part 8. Display unit 19 does not rotate. Thus, display unit 19 can prevent pressing part 8 from being pressed to an extremely displaced location or direction (in a so-called extremely local pressing state).

In a case where the operator presses pressing part 8, spacer 9 moves downward along center axis 110 in accordance with pressing part 8. Specifically, when the operator presses pressing part 8, an outer peripheral portion of the bottom surface of rotating manipulation unit 18 disposed inside pressing part 8 presses spacer 9 downward.

Pressing part 8 can perform a rotation manipulation as well as the pressing manipulation. When the operator rotates pressing part 8, spacer 9 does not in conjunction with the rotation, and instead, rotating manipulation unit 18 inside pressing part 8 rotates in conjunction with the rotation of pressing part 8.

When rotating manipulation unit 18 rotates, displacement concerning the rotation of rotating manipulation unit 18 is detected by a detector (not shown) provided in display unit 19.

Protrusion 21 (first protrusion) is provided on a bottom surface of rotating manipulation unit 18. Protrusion 22 (second protrusion) is provided on a side of click spring 17 facing rotating manipulation unit 18. When rotating manipulation unit 18 rotates by a predetermined degree, protrusion 21 of rotating manipulation unit 18 comes into contact with protrusion 22 of click spring 17. Thus, when the operator performs a rotation manipulation of pressing part 8, the operator can obtain clicking feel with his or her hand or finger.

When pressing part 8 is pressed, click spring 17 is also pressed through rotating manipulation unit 18. At this time, click spring 17 generates an upward lifting force, and when pressing of pressing part 8 is canceled, an upward force toward the initial position is applied to pressing part 8. Thus, it is ensured that pressing part 8 easily returns to the initial position.

As an example in which a pressing manipulation and a rotating manipulation are separately performed, input apparatus 100 is applied to an air conditioner and the rotating manipulation is used as a manipulation for selecting a set temperature, and a pressing manipulation is used as a manipulation for determining the selection.

In this embodiment, pressing part 8 and rotating manipulation unit 18 are different elements. Alternatively, pressing part 8 and rotating manipulation unit 18 may be integrated as pressing part 8.

In this embodiment, even when the operator locally presses pressing part 8, projections 13 press recesses 15, and the pressing force is easily converted to a rotating force of rotating cam 10. Thus, even when the operator performs an insufficient pressing manipulation, input apparatus 100 can sufficiently detect this manipulation. As a result, input apparatus 100 has high operability.

Then, a configuration in which input apparatus 100 informs the operator that switching was performed by input apparatus 100, that is, that the operator correctly pressed pressing part 8, will be described.

For example, as illustrated in FIG. 4, base 16 preferably includes detection mechanism 23. Detection mechanism 23 is constituted by first pressing spring 24 and first contact body 25. First pressing spring 24 is made of an elastic material. First contact body 25 is connected to a front end of first pressing spring 24 near rotating cam 10. FIG. 4 illustrates a state (initial state) where pressing part 8 illustrated in FIG. 1 is not pressed. When pressing part 8 is pressed, rotating cam 10 rotates in direction R in FIG. 4.

In the initial state illustrated in FIG. 4, first contact body 25 is engaged with uneven portion 26 provided in an outer peripheral portion of rotating cam 10. Uneven portion 26 is constituted by projections 120 and 122 and recess 124. Projections 120 and 122 project outward at the outer periphery of rotating cam 10. Recess 124 is provided between projection 120 and projection 122. In the initial state, first contact body 25 is engaged with recess 124 of uneven portion 26.

When pressing part 8 starts being pressed by the operator, rotating cam 10 starts rotating in direction R. Accordingly, first contact body 25 engaged with recess 124 of uneven portion 26 starts being pressed by projection 120 to the direction of first pressing spring 24. As a result, a repulsive force is accumulated in first pressing spring 24.

When pressing part 8 is more deeply pressed by the operator, first contact body 25 moves from recess 124 of uneven portion 26 to the outer periphery of rotating cam 10 outside the uneven portion 26 across projection 120.

Then, when shielding part 20 illustrated in FIG. 3 reaches a location corresponding to sensor 12, sensor 12 detects the rotation of rotating cam 10. That is, sensor 12 detects that the operator pressed input apparatus 100. Then, at the time when shielding part 20 reaches sensor 12 and sensor 12 detects the pressing manipulation, first contact body 25 is released from uneven portion 26.

Projection 120 opposite to recess 124 of uneven portion 26 significantly tilts. Thus, at the time when first contact body 25 is released from uneven portion 26, a force applied on first contact body 25 from uneven portion 26 to the direction of first pressing spring 24 suddenly disappears. Consequently, the repulsive force accumulated in first pressing spring 24 up to this time is rapidly released, and the released repulsive force causes first contact body 25 to hit the outer periphery of rotating cam 10.

At this time, an impact from first contact body 25 is transferred to pressing part 8 through rotating cam 10. Consequently, clicking feel arises. This clicking feel enables the operator to correctly recognize the state of input apparatus 100. Thus, the operator can more precisely issue an instruction to input apparatus 100.

That is, in this embodiment, base 16 of input apparatus 100 includes detection mechanism 23 projecting from guide portion 42 toward the outer periphery of base portion 40. Detection mechanism 23 includes first pressing spring 24 and first contact body 25 disposed at a front end of first pressing spring 24. Rotating cam 10 includes uneven portion 26 on the outer peripheral portion thereof. In the initial state, first contact body 25 is engaged with uneven portion 26, and is released from uneven portion 26 by rotation of rotating cam 10.

In this embodiment, spherical first contact body 25 is used as an example. However, first contact body 25 is not limited to such a spherical shape. First contact body 25 only needs to have a shape that allows a positional relationship between first contact body 25 and uneven portion 26 of rotating cam 10 to change smoothly with first contact body 25 and uneven portion 26 being in contact with each other.

As described above, when the operator releases his or her hand or finger from pressing part 8 after pressing, pressing part 8 returns to the initial position. The initial position herein is a state where projections 13 do not press slopes 14 (projections 13 are not in contact with slopes 14), and corresponds to a highest position to which pressing part 8 rises in FIG. 1. For example, as illustrated in FIG. 4, base 16 may include return mechanism 27. In this case, the operation described above can be accurately performed.

Return mechanism 27 is constituted by second pressing spring 28 and second contact body 29. Second pressing spring 28 is made of an elastic material.

Second contact body 29 is connected to a front end of second pressing spring 28 near rotating cam 10. As described above, FIG. 4 illustrates the initial state where pressing part 8 illustrated in FIG. 1 is not pressed. When pressing part 8 is pressed, rotating cam 10 rotates in direction R illustrated in FIG. 4.

In the initial state illustrated in FIG. 4, second pressing spring 28 presses outer protrusion portion 30 through second contact body 29. Outer protrusion portion 30 is disposed in an outer peripheral portion of rotating cam 10. Outer protrusion portion 30 is provided to prevent rotating cam 10 from moving in the direction opposite to direction R by a predetermined degree. That is, outer protrusion portion 30 stops movement of rotating cam 10 in the direction opposite to direction R at a limit position.

When pressing part 8 is pressed by the operator, rotating cam 10 rotates in direction R. Accordingly, outer protrusion portion 30 presses second contact body 29 to the direction of second pressing spring 28. As a result, a repulsive force is accumulated in second pressing spring 28.

When the operator stops pressing, a repulsive force of second pressing spring 28 causes outer protrusion portion 30 to rotate in the direction opposite to direction R to be pushed back to the limit position. That is, when the operator releases his or her hand or finger from pressing part 8 after pressing, pressing part 8 returns to the initial position. The operation described above is performed independently of the amount of pressing of pressing part 8.

That is, base 16 of input apparatus 100 includes return mechanism 27 projecting from guide portion 42 toward the outer periphery of base portion 40. Return mechanism 27 includes second pressing spring 28 and second contact body 29 disposed at a front end of second pressing spring 28. Rotating cam 10 includes outer protrusion portion 30 in the outer periphery thereof. Pressing of second contact body 29 by outer protrusion portion 30 restricts rotation of rotating cam 10.

Detection mechanism 23 and return mechanism 27 are preferably defined to satisfy the following relationship. A force with which return mechanism 27 presses outer protrusion portion 30 is always greater than a resistance to rotation applied to rotating cam 10 when rotating cam 10 rotates in the direction opposite to direction R.

In this manner, when the operator releases his or her hand or finger from pressing part 8 after pressing, pressing part 8 always returns to the initial position.

In this embodiment, a sensor 12 constituted by a light-emitting part (not shown) and a light-receiving part (not shown) is disposed on board 46. Alternatively, a plurality of such sensors 12 may be disposed on board 46. As the manipulation described above, the operator presses input apparatus 100 to select one of an ON state or an OFF state. However, in the case where multiple sensors 12 are disposed on board 46, the operator can control not only the ON or OFF state of input apparatus 100 but also the pressing manipulation stepwise or quantitatively. The sensor(s) 12 may not be disposed on board 46 and may be disposed on, for example, base 16.

As described above, according to the present disclosure, conversion mechanisms 11 can smoothly convert a pressing operation to a rotating operation. Thus, the operator can press tilted pressing part 8, thus obtaining input apparatus 100 with high operability.

INDUSTRIAL APPLICABILITY

An input apparatus according to the present invention has the advantage of high operability, and is useful for various types of electronic equipment.

The invention claimed is:

1. An input apparatus comprising:

a pressing part capable of reciprocating along a first direction;

a spacer disposed in the first direction with respect to the pressing part, and capable of reciprocating along the first direction with reciprocation of the pressing part;

a rotating cam that is disposed at a side of the spacer opposite to the pressing part and rotates in a plane perpendicular to the first direction with reciprocation of the spacer;

a sensor that detects rotation of the rotating cam, and a rotating manipulation unit at least partially disposed inside the pressing part, wherein either a plurality of projections are provided on a surface of the spacer facing the rotating cam, whereas a plurality of recesses are provided in the rotating cam at locations facing the plurality of projections of the spacer, or a plurality of projections are provided on a surface of the rotating cam facing the spacer, whereas a plurality of recesses are provided in the spacer at locations facing the plurality of projections of the rotating cam, each of the plurality of recesses has a slope, and pressing of the pressing part causes the spacer to be pressed, and at least one of the plurality of projections presses the slope so that the rotating cam rotates and the sensor detects rotation of the rotating cam, and wherein the rotating manipulation unit is configured in such a manner that:

when the pressing part is pressed, the rotating manipulation unit presses the spacer by a bottom surface of the rotating manipulation unit, and when the pressing part is rotated, the rotating manipulation unit rotates in conjunction with rotation of the pressing part.

2. The input apparatus of claim 1, further comprising:

a click spring disposed between the rotating manipulation unit and the spacer, wherein a first protrusion is provided on the bottom surface of the rotating manipulation unit, a second protrusion is provided on a side of the click spring facing the rotating manipulation unit, and when the rotating manipulation unit rotates by a predetermined degree, the first protrusion contacts the second protrusion.

3. An input apparatus comprising:

a pressing part capable of reciprocating along a first direction;

a spacer disposed in the first direction with respect to the pressing part, and capable of reciprocating along the first direction with reciprocation of the pressing part;

a rotating cam that is disposed at a side of the spacer opposite to the pressing part and rotates in a plane perpendicular to the first direction with reciprocation of the spacer;

a sensor that detects rotation of the rotating cam, and a base disposed at a side of the rotating cam opposite to the spacer, wherein either a plurality of projections are provided on a surface of the spacer facing the rotating cam, whereas a plurality of recesses are provided in the rotating cam at locations facing the plurality of projections of the spacer, or a plurality of projections are provided on a surface of the rotating cam facing the spacer, whereas a plurality of recesses are provided in the spacer at locations facing the plurality of projections of the rotating cam, each of the plurality of recesses has a slope, and pressing of the pressing part causes the spacer to be pressed, and at least one of the plurality of projections presses the slope so that the rotating cam rotates and the sensor detects rotation of the rotating cam, and wherein the base includes a base portion, and a guide portion disposed around the rotating cam and projecting from the base portion toward the spacer, the spacer is guided by the guide portion, the base includes a detection mechanism projecting from the guide portion toward an outer periphery of the base portion, the detection mechanism includes a first pressing spring and a first contact body disposed at a front end of the first pressing spring, the rotating cam includes an uneven portion in an outer peripheral portion of the rotating cam, and in an initial state, the first contact body is engaged with the uneven portion, and rotation of the rotating cam causes the first contact body to be released from the uneven portion.

4. An input apparatus comprising:

a pressing part capable of reciprocating along a first direction;

a spacer disposed in the first direction with respect to the pressing part, and capable of reciprocating along the first direction with reciprocation of the pressing part;

a rotating cam that is disposed at a side of the spacer opposite to the pressing part and rotates in a plane perpendicular to the first direction with reciprocation of the spacer;

a sensor that detects rotation of the rotating cam, and a base disposed at a side of the rotating cam opposite to the spacer, wherein either a plurality of projections are provided on a surface of the spacer facing the rotating cam, whereas a plurality of recesses are provided in the rotating cam at locations facing the plurality of projections of the spacer, or a plurality of projections are provided on a surface of the rotating cam facing the spacer, whereas a plurality of recesses are provided in the spacer at locations facing the plurality of projections of the rotating cam, each of the plurality of recesses has a slope, and pressing of the pressing part causes the spacer to be pressed, and at least one of the plurality of projections presses the slope so that the rotating cam rotates and the sensor detects rotation of the rotating cam, and wherein the base includes a base portion, and a guide portion disposed around the rotating cam and projecting from the base portion toward the spacer, the spacer is guided by the guide portion, the base includes a return mechanism projecting from the guide portion toward an outer periphery of the base portion, the return mechanism includes a second pressing spring and a second contact body disposed at a front end of the second pressing spring, the rotating cam includes an outer protrusion portion in an outer peripheral portion of the rotating cam, and pressing of the second contact body by the outer protrusion portion restricts rotation of the rotating cam.

* * * * *